United States Patent [19]

Zivanovic

[11] Patent Number: 5,036,684

[45] Date of Patent: Aug. 6, 1991

[54] SECURITY DEVICE FOR VEHICLE CLOSING SYSTEMS

[76] Inventor: Milovoje Zivanovic, 98, rue Jean Jaurès, 92300 Levallois, France

[21] Appl. No.: 622,404

[22] Filed: Dec. 3, 1990

Related U.S. Application Data

[63] Continuation of Ser. No. 337,229, Apr. 12, 1989, abandoned.

[30] Foreign Application Priority Data

Apr. 15, 1988 [FR] France ..... 88 04989

[51] Int. Cl.[5] ..... B65D 55/14; E05C 3/04

[52] U.S. Cl. ..... 70/161; 16/361; 49/394; 70/DIG. 65; 292/210; 292/218; 292/DIG. 32

[58] Field of Search ..... 49/394; 16/357, 360, 16/361, 374; 70/159-162, DIG. 65; 292/218, 205, 210, 11, DIG. 21, DIG. 29, DIG. 32

[56] References Cited

U.S. PATENT DOCUMENTS

| | | | |
|---|---|---|---|
| 937,503 | 10/1909 | Asch | 70/159 |
| 1,555,781 | 9/1925 | Amsden | 16/357 X |
| 4,058,994 | 11/1977 | Coppola | 70/159 X |
| 4,228,983 | 10/1980 | Bowman, Jr. | 70/161 X |
| 4,593,541 | 6/1986 | Hollis | 70/161 X |

FOREIGN PATENT DOCUMENTS

| | | | |
|---|---|---|---|
| 2916167 | 11/1979 | Fed. Rep. of Germany | 292/11 |

*Primary Examiner*—Lloyd A. Gall

*Attorney, Agent, or Firm*—Browdy and Neimark

[57] ABSTRACT

A security device for closing systems for vehicles and containers comprising a base plate fastened to the chassis of the vehicle holding a hinging shaft and one of two essential elements of a lock, i.e., the catch or sliding bolt; and a closing arm, one end of which hinges on the base plate by means of said shaft, the other end holding the other element of the lock. The plate and the arm form a parallelpipedal flat space when the device is in a closed position, which serves to house and lock the lower bent ends of the closing shaft of the vehicle door.

3 Claims, 3 Drawing Sheets

SECURITY DEVICE FOR VEHICLE CLOSING SYSTEMS

This application is a continuation of application Ser. No. 07/337,229, filed Apr. 12, 1989 now abandoned.

FIELD OF THE INVENTION

This invention pertains to a security device to make closing systems for vehicles such as trucks, vans, semi-trailers, and, more generally speaking, all containers, secure against break-ins.

BACKGROUND OF THE INVENTION

In their most widely-used forms, the rear doors of trucks and the doors of containers are composed of two panels. Each panel is kept in the position in which the door is closed through the cooperation of a shaft or casement bolt unitary with said panel and catch fingers unitary with the chassis of the truck or container. Said shaft, which is generally vertical, can turn around its longitudinal axis under the action of a control handle provided for this purpose; its lower end is bent at a right angle, and the resulting horizontal branch is designed to engage between the aforementioned catch fingers unitary with the lower part of the chassis. Said closure devices are not secure against break-ins, and they are generally locked using one or more padlocks, which, unfortunately, are easy to break.

SUMMARY OF THE INVENTION

The invention aims to correct this problem and for this purpose provides a device to lock the closing shaft in rotation. Said device is composed of a combination of the following:

A base plate fastened to the chassis of the vehicle, holding one of the two essential elements of a lock, i.e., its catch or sliding bolt, as well as a hinging shaft.

And a closing arm, one end of which hinges on the base plate by means of said shaft, the other end holding the other element of the lock, i.e., its sliding bolt or catch, said plate and said arm forming a parallelepipedal flat space when the device is in closed position, which serves to house and lock the lower bent ends of the closing shaft(s) of the vehicle door(s).

The axle by which the closing arm hinges on the base plate is vertical or horizontal, depending on whether the door(s) open by swinging in a horizontal plane (one or two-panel doors) or if they open by swinging in a vertical plane (flap doors).

In this way, in one embodiment of a device designed for two- panel doors that swing in a horizontal plane, the base plate and closing arm occupy substantially horizontal positions and are connected by a vertical shaft passing through vertical supports provided at one of the ends of the base plate and closing arm.

In another embodiment intended more specifically but not exclusively for the same two-panel doors, the closing arm is hinged over its entire length on a horizontal shaft on the lower edge of the base plate unitary with the chassis, with the means for locking the arm with respect to the base plate being provided respectively on both of these components, in order to close the security device.

Said locking means are, on the one hand, the lock with its sliding bolt, and, on the other hand, the lock catch. The lock is advantageously held by the closing arm, with the lock catch in this case being located on the base plate. In another embodiment, the lock is held by the base plate and the catch is placed on the closing arm.

Additional characteristics of the invention will be disclosed in the description below, with reference to the attached schematic drawing which provides two embodiments of this security device, as non-restrictive examples:

DETAILED DESCRIPTION OF THE INVENTION

Figure 1:
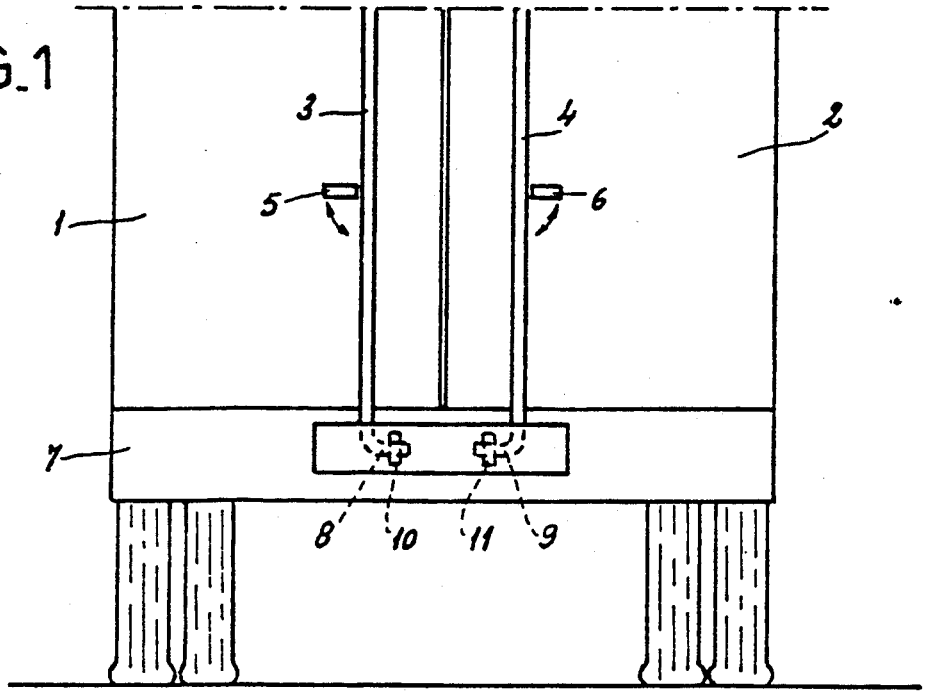
FIG. 1 is a simplified partial view of the back of a truck equipped with said security device.

With reference to FIG. 1, a truck is equipped with a rear door having two panels 1 and 2. A vertical closing shaft, respectively 3 and 4, is mounted on each of said panels, the rotation of said shafts being controlled by a handle, respectively 5 and 6.

The lower end of each rotating shaft 3, 4 is located on the lower part 7 of the rear chassis of the truck, and is bent horizontally. The lower horizontal branches 8, 9 of shafts 3, 4 are designed to engage between catch fingers, respectively 10 and 11, which are unitary with chassis 7.

In the absence of a locking device, it suffices to move handles 5, 6 causing shafts 3, 4 to rotate around their respective longitudinal axes, so that branches 8, 9 disengage from the respective pairs of fingers 10, 11, and the door can be opened. Locking device 12, which is the object of the invention and is described below in two embodiments, makes this rotation impossible.

Figure 3:
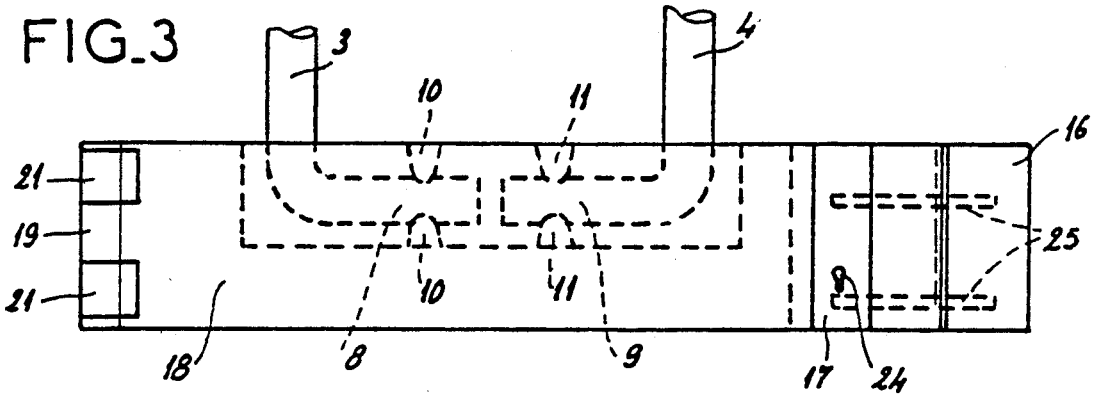
FIG. 3 is a front view with the closing shafts in locked position.
Figure 4:
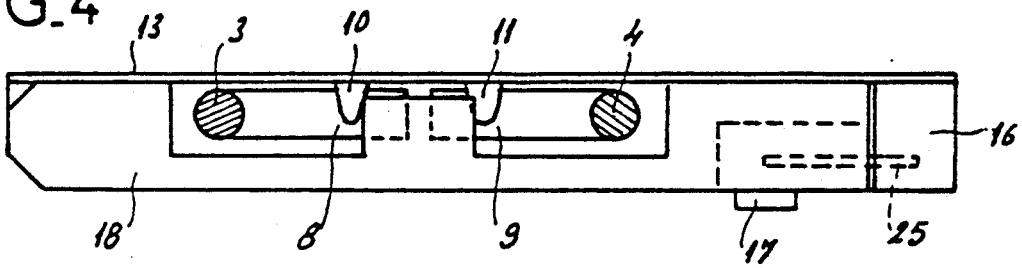
FIG. 4 is a top view of the device in the same position.
Figure 2:
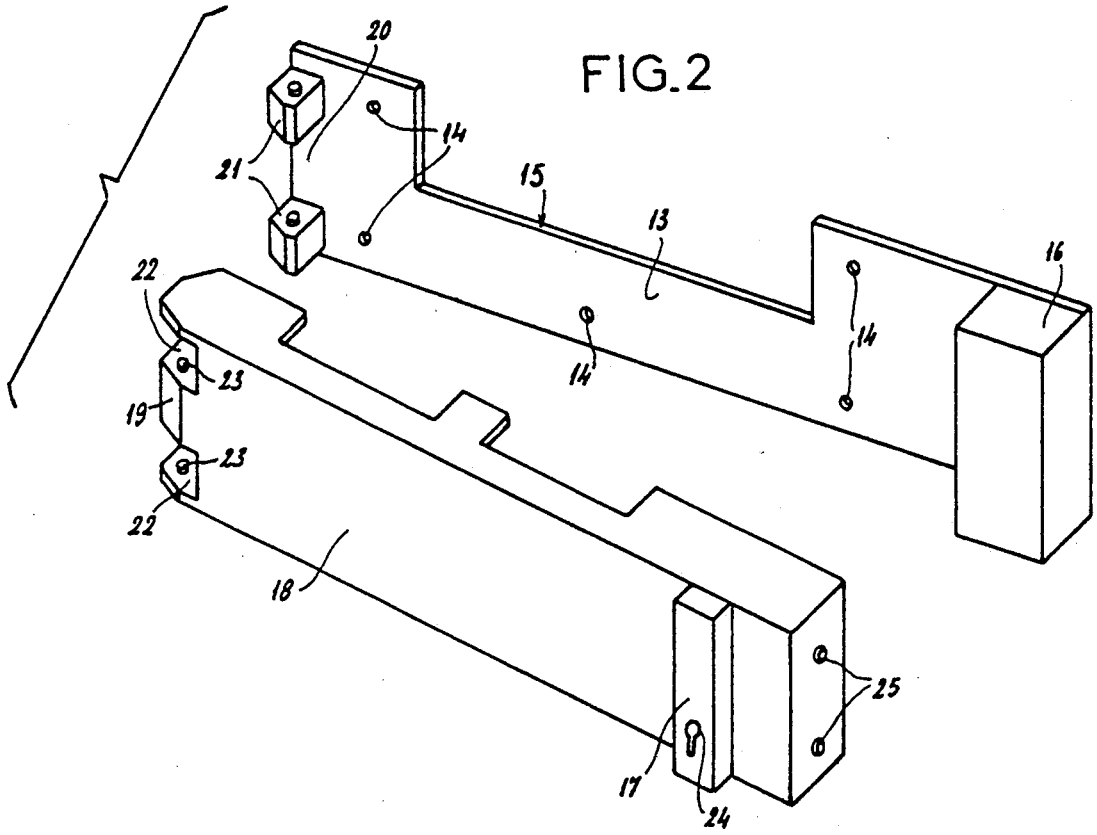
FIG. 2 is an exploded perspective view of a first embodiment of said device.
Figure 5:
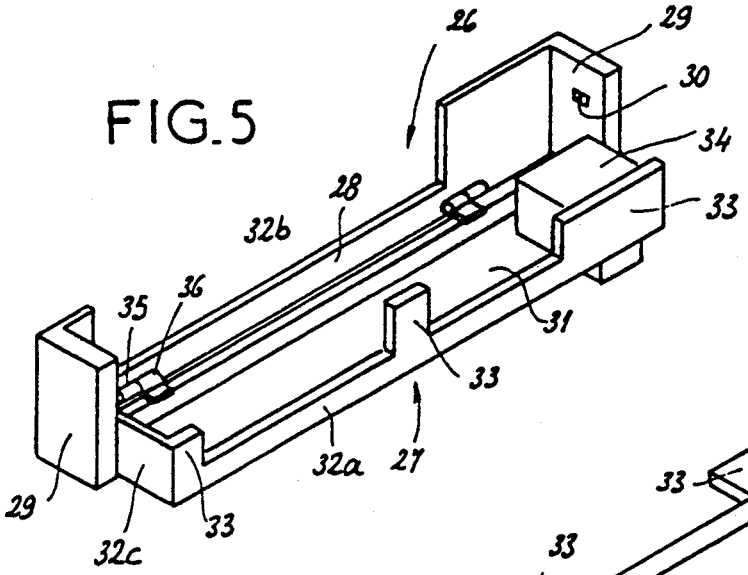
FIGS. 5 and 6 are perspective views of a second embodiment, respectively in the open and closed positions.

With reference to FIGS. 2 to 4, which show the first embodiment, the device is composed of a base plate 13 extended in the horizontal direction, which is attached to the middle of the lower back part 7 of the chassis by screw 14. Said plate 13 has an upper cavity 15 large enough to provide the space needed for catch fingers 10, 11, and the corresponding branches 8, 9 of the two shafts 3 and 4 (FIG. 3).

One of the ends of plate 13 holds catch 16 of a lock 17 which itself is held by the free end of a horizontal arm 18, the other end 19 of which is hinged on end 20 of plate 13, which is opposite the end holding catch 16. The joint is secure against break-ins and is composed of a hinge, two supports 21 of which are held by end 20 of plate 13, and two other supports 22 of which are placed at the corresponding end 19 of arm 18. The pins of said hinge are composed of fingers 23 mounted on springs and cooperating with the corresponding cavities in the other part of the hinge. Lock 17 is equipped with a hole 24, for a control key as well as a sliding bolt composed of two shafts 25.

As shown in the drawing, when arm 18 presses against plate 13 and consequently sliding bolt 25 of lock 17 is opposite the corresponding openings of catch 16, and when the two shafts 3 and 4 are also turned (FIGS. 1, 3 and 4) to the position in which the door is closed, the bent ends 8, 9 of said shafts are imprisoned by said arm 18, thus preventing shafts 3 and 4 from rotating when lock 17 is closed (position in FIGS. 3 and 4).

Manipulating this device in order to lock the two doors 1, 2 of the truck is an extremely simple operation. With the two doors pushed into closed position, the hinged arm 18 being opened to approximately a 90-degree angle with respect to base plate 13, handles 5 and 6 are first moved, causing the corresponding shafts 3 and 4 to rotate and thus to lock horizontal branches 8 and 9 between the corresponding pairs of fingers 10 and 11. Hinged arm 18 is then pushed against base plate 13, and lock 17 is closed so that its sliding bolts 25 enter the corresponding openings of catch 16. The resulting position is shown in FIGS. 3 and 4; branches 8 and 9 of shafts 3 and 4 are blocked in position between arm 18 and plate 13, and the two doors 1 and 2 of the truck are locked in closed position.

To unlock the device, it suffices to open lock 17 and turn arm 18 in the clockwise direction in order to release horizontal branches 8, 9 of shafts 3, 4.

In the second embodiment shown in FIGS. 5 to 9, 26 and 27 designate respectively and in general the base plate attached to the chassis of the vehicle and the closing arm hinged to said base plate.

Base plate 26 comprises a bottom 28 which is hollow in its upper middle part and which is extended laterally by two flanges 29. One of said flanges is designed to constitute a catch 30.

Closing arm 27 itself comprises a bottom 31 having longitudinal wings 32*a* and 32*b*, one of which 32*a* is equipped with three extensions 33, and said two wings 32*a*, 32*b* are connected at one end by a lateral flange 32c. A lock 34 is attached to the bottom 31 between wings 32*a*, 32*b*, at their other end. Said lock 34 projects outside of bottom 31 of closing arm 27 through an opening placed in said bottom. Bottom 28 of base plate 26 and wing 32*b* of bottom 31 of closing arm 27 are equipped with additional supports 35, 36, through which pass shafts 37 allowing closing arm 27 to hinge on base plate 26 around a general horizontal shaft.

Figure 6:
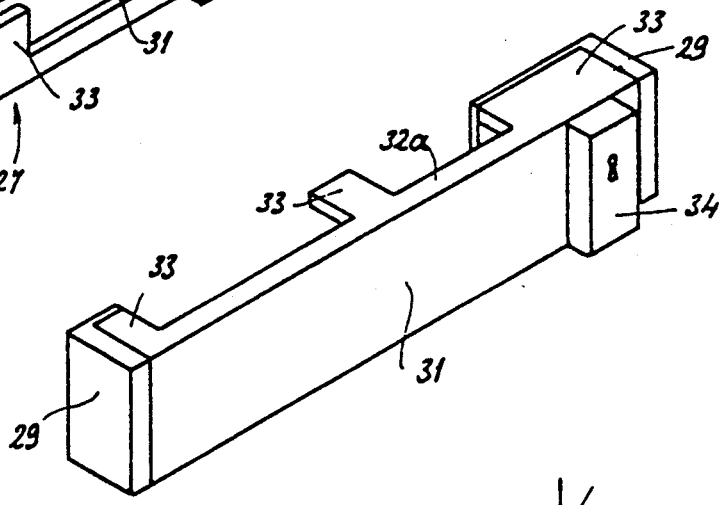
Figure 7:
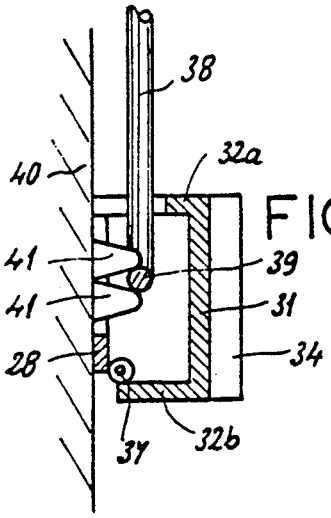
FIGS. 7 and 8 are vertical cross section views along VII—VII and VIII—VIII in FIG. 9.
Figure 8:
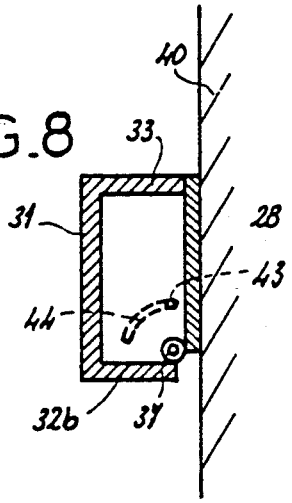
Figure 9:
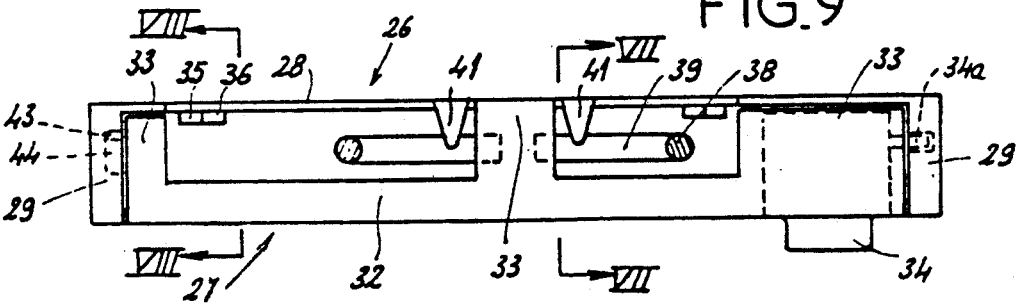
FIG. 9 is a flat view from the top in closed position.

When the security device is in its closed position shown in FIGS. 6, 7 and 8, arm 27 is turned down and against base plate 26; the device is closed when sliding bolt 34*a* of lock 34 enters catch 30. In this closed position, the two lateral extensions 33 of closing arm 27 press against bottom 28 of base plate 26, while center extension 33 is flush with fixed rear part 40 of the vehicle, with which two pairs of fingers 41 are unitary, said fingers protruding inside the space defined by base plate 26.

In the drawing, 38 designates the two casement bolt shafts, which are held by the two doors of the vehicle and whose lower bent ends 39 are engaged between the fixed fingers 41 when the security device is in closed position. In said position, any opening of the door is impossible because closing arm 27, locked by its sliding bolt 34*a* in catch 30 of the base plate, makes it impossible for the casement bolt 38 shafts to rotate, the bent ends 39 of the latter being held laterally by closing arm 27.

A supplementary device is provided to prevent any risk of burglary by the deliberate deformation of closing arm 27 at its end opposite lock 34. This involves a tappet 43 which is held by flange 32*c* of the arm, is directed towards the outside and enters a groove 44 placed on the inside surface of flange 29 of base plate 26, concentrically to hinge shaft 37 of arm 27 on plate 26. It still must be noted that the respective positions of finger 43 and opening 44 on flanges 32*c* and 29 may be reversed, with tappet 43 in this case being held by flange 29 of base, plate 26, and opening 44 being placed in flange 32*c* of closing arm 27.

The opening of the vehicle door(s) requires that said arm 27 first be opened. Said opening is achieved by manipulating lock 34, whose sliding bolt 34*a* must disengage from catch 30. After the lock is opened, arm 27 can be turned down, with tappet 43 sliding in opening 44 until it stops against its lower end. In this case, the device is in the position shown in FIG. 5, wherein it is possible to turn casement bolts 38, whose bent lower ends 39 are no longer held by closing arm 27.

The lock 34 may be any type and is advantageously designed to be equipped with a fixed key, i.e., a key that can only be disengaged from the lock when the latter is in closed position, which makes it impossible to lose the key when the lock is open.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A security device for a vehicle or container, said vehicle or container including a door, said door having at least one panel, said door including a closing system for each panel;

said vehicle or container having catch fingers integral therewith;

said closing system comprising a shaft unitary with said panel and an operating handle;

said shaft adapted and constructed to turn around its longitudinal axis under the action of said operating handle;

said shaft having one bent end adapted and constructed to cooperate when in a closed position with said catch fingers;

said security device comprising:

a base plate unitary with said vehicle or container, said base plate also holding a hinging shaft and at least one of a catch of a lock and a sliding bolt;

a closing arm having a first end and a second end;

said plate and said arm defining a parallelpipedal flat space when the device is in closed position;

the bent end of said shaft housed in said space when said device is in a closed position;

means for locking said closing arm with respect to said base plate being provided respectively on both of said base plate and said closing arm in order to close the security device;

said means for locking comprises said catch held by said base plate and said sliding fact placed on said closing arm;

wherein said lock is placed at one end of said base plate and said closing arm, said plate and said closing arm each having at their outer extremity a flange;

wherein one of said flanges holds a tappet adapted and constructed to slide in an opening placed in the other flange, concentrically to the horizontal axis on which said closing arm hinges on said base plate, and wherein said closing arm is hinged over its entire length around said hinging shaft on the lower edge of said base plate integral with the vehicle or container.

2. A security device for a door of a vehicle having at least one panel, said door including a closing system for each panel;

said vehicle including a chassis having catch fingers integral therewith;

said closing system comprising a shaft unitary with said pane, and an operating handle;

said shaft adapted and constructed to turn around its longitudinal axis under the action of said operating handle;

said shaft having one bent end adapted and constructed to cooperate when in a closed position with said catch fingers;

said security device comprising:

a base plate unitary with said chassis, said base plate also holding a hinging shaft and one of two essential elements of a lock, said essential elements being a catch and a sliding bolt;

a closing arm having a first end and a second end;

said plate and said arm defining a parallelpipedal flat space when the device is in closed position;

the bent end of said shaft being housed in said space when said device is in a closed position;

wherein said closing arm is hinged over its entire length around said hinging shaft on the lower edge of said base plate integral with the chassis;

means for locking said closing arm with respect to said base plate provided respectively on both of said base plate and said closing arm in order to close the security device;

wherein said catch and catch are placed at one end of said base plate and said closing arm, said plate and said closing arm each having at their outer extremity a flange;

one of said flanged holds a tappet adapted and constructed to slide in an opening placed in the other flange, concentrically to the horizontal axis on which said closing arm hinges on said base plate.

3. The security device according to claim 2 wherein said opening forming an arc centered on the shaft on which said closing arm hinges on said base plate.

* * * * *